United States Patent [19]

Hanson

[11] Patent Number: 4,598,193

[45] Date of Patent: Jul. 1, 1986

[54] APPARATUS FOR HEATING SHOE PARTS

[75] Inventor: Raymond Hanson, Rearsby, England

[73] Assignee: USM Corporation, Farmington, Conn.

[21] Appl. No.: 615,921

[22] Filed: May 31, 1984

[30] Foreign Application Priority Data

Jun. 29, 1983 [GB] United Kingdom ..... 8317647

[51] Int. Cl.[4] ..... H05B 3/06; A45D 95/12

[52] U.S. Cl. ..... 219/215; 219/521; 219/354; 12/41.5; 12/59.7

[58] Field of Search ..... 219/215, 521, 405, 411, 219/354, 348, 347, 85 BA, 85 BM; 12/1 A, 41.5, 59.7

[56] References Cited

U.S. PATENT DOCUMENTS

| | | | |
|---|---|---|---|
| 2,694,131 | 11/1954 | Carson | 219/215 |
| 3,180,247 | 4/1965 | Hill | 219/411 |
| 3,199,130 | 8/1965 | Sprague | 12/41.5 |
| 3,254,198 | 5/1966 | Card | 219/354 |
| 3,517,160 | 6/1970 | Maga | 219/215 |
| 3,533,117 | 10/1970 | Dinolfo | 12/1 A |
| 3,674,975 | 7/1972 | Nugent | 219/85 BA |
| 3,739,413 | 6/1973 | Freeman | 12/1 A |
| 4,517,442 | 5/1985 | Price | 219/215 |

*Primary Examiner*—Clarence L. Albritton
*Assistant Examiner*—Teresa J. Walberg
*Attorney, Agent, or Firm*—Spencer T. Smith

[57] ABSTRACT

A shoe machine for heating a shoe part is disclosed having a housing which defines a chamber. Shrouds are located centrally within the chamber defining first and second operating zones on either side of the shrouds. A heater is displaceable from a first operating position within the first operating zone to a park position within the shrouds to a second operating position within the second operating zone, and heats shoe parts supported within the first and second operating zones.

6 Claims, 2 Drawing Figures

APPARATUS FOR HEATING SHOE PARTS

BACKGROUND OF THE INVENTION (1) Field of the Invention

This invention is concerned with apparatus for heating shoe parts whereby adhesive on a surface of such parts can be activated, said apparatus comprising a heater arranged to emit infra-red radiation and having a continuous heating surface which is of an area greater than that of the shoe part to be heated, said surface being maintained at operating temperature, when the apparatus is in use, not only during an operating cycle but also between successive cycles, a support for supporting a shoe part to be heated, and drive means for effecting relative movement between the heater and the support, in a first direction to bring the heater and support into an opposed relationship, in which a shoe part supported by the support can be heated by the heater, and in a return direction to move the heater and support out of such opposed relationship.

(2) Prior Art

By using an infra-red heater having a continuous heating surface of area greater than that of the shoe part to be heated, it is possible more readily to control the amount of heat to which the shoe part is to be subjected, and thus to control more accurately than has previously been the case the amount of time required to activate the adhesive coating on the surface of the shoe part. In practice, it has been found that an operating time of between 4 and 8 seconds, preferably 6 seconds is adequate for activating the adhesive.

Apparatus of the type referred to are suitable for use in combination with a so-called cement sole attaching machine, in the operation of which shoe sole units are secured by adhesive to bottoms of lasted shoe uppers. Thus, the operator takes a shoe sole unit and a lasted shoe upper, with the adhesive coatings on one or both parts activated using the subject apparatus, and assembles the parts in a desired relationship prior to inserting them into the cement sole attaching machine. The total cycle time for this latter machine is, however, somewhat longer than the operating cycle time for the apparatus.

With other apparatus used for heating shoe parts, e.g. in preparation for cement sole attaching operation, it is customary either to switch off the heat after a desired period, or it has been suggested to reduce the heat output by a half, so that the adhesive is not subjected to excessive heating during the intervening period before it is assembled as aforesaid. With certain adhesives, however, only a relatively restricted amount of time after activation is available for carrying out the bonding operation, and in any event, in the case of any adhesive it is usually at an optimum stage for use in the bonding operation immediately at the end of the heating operation.

It is consequently the object of the present invention to provide an improved apparatus for heating shoe parts, wherein the bringing of an adhesive coating thereon to its optimum condition for the subsequent bonding operation can be set so as substantially to coincide with the operator being ready to utilize the part in such bonding operation.

BRIEF SUMMARY OF THE INVENTION

The invention thus provides apparatus for heating shoe parts whereby adhesive on a surface of such parts can be activated, said apparatus comprising a heater arranged to emit infra-red radiation and having a continuous heating surface, which is of an area greater than that of the shoe part to be heated, said surface being maintained at operating temperature, when the apparatus is in use, not only during an operating cycle but also between successive cycles, a support for supporting a shoe part to be heated, drive means for effecting relative movement between the heater and the support, in a first direction to bring the heater and support into an opposed relationship, in which a shoe part supported by the support can be heated by the heater, and in a return direction to move the heater and support out of such opposed relationship, first timer means by which the initiation of relative movement in the first direction can be delayed for a pre-determined time, and second timer means, operable when the heater and shoe support are brought into opposed relationship as aforesaid, to maintain them in said relationship for a further pre-determined time and thereafter to initiate relative movement therebetween in said return direction.

This combination of first and second timer means enables the operator to load the apparatus and initiate a cycle of operation, whereafter he can turn his attention to the loading of the cement sole attaching machine, the arrangement of timers being such that, when the operator is ready to load a further shoe at the cement sole attaching machine, the shoe parts, or one of them, will be just activated using the apparatus.

For initiating a cycle of operation of the apparatus, any suitable actuating means may be provided. Thus, for example, shoe part detecting means may be provided which, in response to a shoe part being placed upon the support, initiates an operating cycle. For simplicity of design, on the other hand, preferably actuating means is provided, operable by the operator, for initiating an operating cycle, operation of said means being effective to actuate the first timer means which, upon timing out, caused the drive means to be actuated to effect relative movement in said first direction between the heater and support.

Whereas the invention is applicable to an apparatus having a single support between which and the heater relative movement can take place as aforesaid, in a preferred embodiment the apparatus comprises a heater arranged to emit infra-red radiation and having a continuous heating surface, which is of an area greater than that of the shoe part to be heated, said surface being maintained at operating temperature, when the apparatus is in use, not only during an operating cycle but also between successive cycles, and two supports each for supporting a shoe part to be heated, the arrangement being such that, in the rest condition of the apparatus, the heater is disposed at a level spaced from the level of the supports, with the supports disposed one at either side of the heater and accessible to the operator, the apparatus also comprising drive means for effecting relative movement between the heater and the supports, in a first direction to bring the heater and one of the supports into opposed relationship in which a shoe part supported by the support can be heated by the heater, and in a return direction to move the heater and support out of such opposed relationship, or in a second direction to bring the heater and the other of the supports into such relationship, and thereafter in a return direction to return them to the rest condition, first timer means by which the initiation of relative movement in the first or second direction, as the case may be, can be delayed for a pre-determined time, and second timer means, operable when the heater and a selected one of the supports are brought into opposed relationship as aforesaid, to maintain them in said relationship for a further pre-determined time and thereafter to initiate relative movement therebetween in a return direction.

By providing two supports, it has been found that the apparatus can more readily be adapted for use in combination with a cement sole attaching press, which in any event is usually a two-station machine.

The drive means of the apparatus may be effective to move either one of the supports into opposed relationship with the heater, to which end, if desired, two separate motors may be provided, one associated with each support. In a preferred embodiment of the invention, however, the drive means comprises a motor by which the heater is movable between a central "parking" position, at which it is disposed when the apparatus is in its rest condition, and a selected one of two operating positions, in which it is disposed in opposed relationship with one of the supports. Furthermore, in such a case, conveniently actuating means is provided operable by the operator, for initiating an operating cycle, said means comprising two actuators, one associated with each support, and operation of a selected one of said actuators being effective to actuate the first timer means which, upon timing out, causes the motor of the drive means to be actuated to cause the heater to be moved from its "parking" position to the appropriate operating position.

Thus, preferably, between successive operating cycles, when the heater and the support (s) are out of opposed relationship as aforesaid, the heater is substantially enclosed by screens. In addition, preferably the heater comprises opposed continuous heating surfaces, the or each support being arranged to support a shoe sole unit beneath the heater, when the heater and support are in opposed relationship as aforesaid, and further the or each support having associated therewith a further support, the arrangement being such that the heater and further support are brought into opposed relationship with one another when the heater and support are brought into such relationship, in which relationship the further support is arranged to support a lasted shoe, bottom down, above the heater.

Within certain limitations, the speed at which an operator utilizes the cement sole attaching machine will be determined by his skill and dexterity, so that the operating cycle of said machine will vary from operator to operator. In order to accommodate this in the apparatus in accordance with the invention, preferably the pre-determined time delay provided by the first timer means can be set by the operator. If desired, furthermore, bearing in mind that different adhesives may require different operating cycles, the dwell time provided by the second timer means may also be set by the operator.

By providing a time delay before the start of the operating cycle of the apparatus in accordance with the invention, it will be appreciated that the operator can now so set the apparatus that the shoe part, whether shoe sole unit or lasted shoe upper or both, can be presented to the operator with its adhesive surface just activated at the time when he requires it (or them) for the next operating cycle of the shoe sole attaching machine.

BRIEF DESCRIPTION OF THE DRAWINGS

There now follows a detailed description, to be read with reference to the accompanying drawings, of one apparatus in accordance with the invention. It will be understood that this apparatus has been selected for description merely by way of exemplification of the invention and not by way of limitation thereof.

In the accompanying drawings.

DESCRIPTION OF THE PREFERRED EMBODIMENTS

Figure 1:
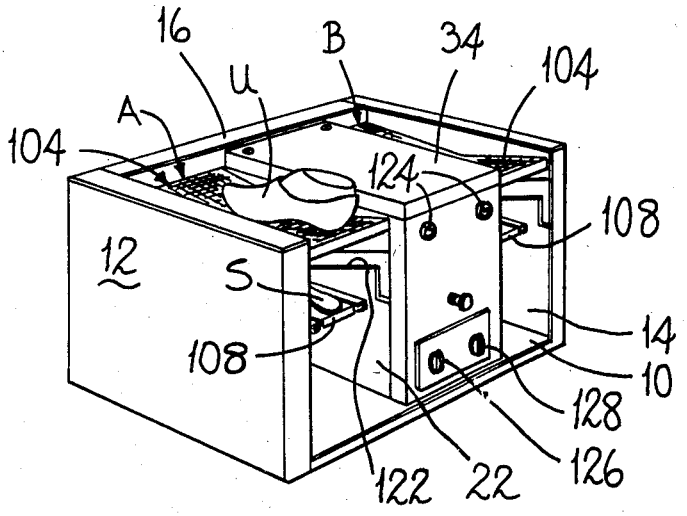
FIG. 1 is a perspective view of the apparatus.

The apparatus comprises a supporting framework of aluminum sheet material comprising a base 10, side walls 12, 14 and a rear wall 16, the side interior walls being each constituted by two plates with an insulating gap therebetween. Within the framework are provided three stations or chambers, constituting a central "parking" station for a heater member 82, and left and right hand operating stations A,B arranged one at either side thereof, the heater 82 being movable between the various stations under the action of drive means, constituted by a motor 96 operating through a chain-and-sprocket arrangement 98, 100. To this end, the heater 82 is mounted on a carriage 56 having a plurality of rolls 52, 54 arranged to run on rails 50,48 supported by the framework.

Figure 2:
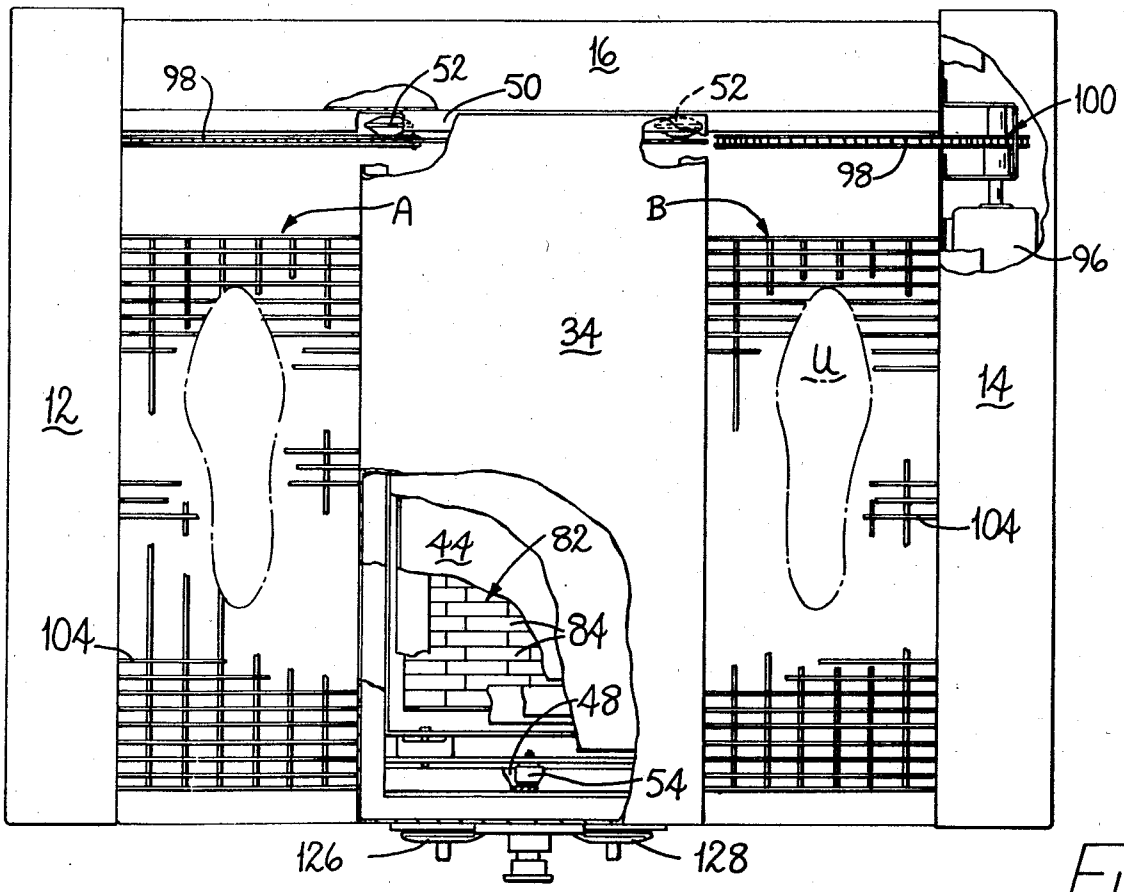
FIG. 2 is a plan view, with parts broken away, of the apparatus shown in FIG. 1.

The heater member 82 is in the form of a plate made up of an array of ceramic blocks 84 which have electric heating elements embedded therein and passing from block to block. The heater member 82 thus provides upper and lower continuous heating surfaces. As will be noted from FIG. 2, furthermore, each heating surface of the heater 82 is of an area greater than the area of the shoe part to be heated thereby, in casu a lasted shoe upper U or shoe sole unit S (see also FIG. 1). For better to accommodate to the shape of the surfaces of the shoe parts to be heated, furthermore, the heater member 82 is generally V-shaped in transverse cross-section, having two generally planar portions inclined to one another at 150°.

The heater member 82 is arranged to emit infra-red radiation for activating adhesive as aforesaid. The central "parking" station for the heater member, apart from being defined by side walls 22, is thus also provided with an arrangement of screens which reflect infra-red radiation, so as to protect the operator from exposure to uncomfortable amounts of heat and also in order to reduce the energy requirements of the apparatus. The screen arrangement thus comprises two screens which are generally V-shaped so as to provide a generally V-shaped chamber in which the heater is accommodated in the "parking" position. The upper (44) of the screens can be seen in FIG. 2. In addition, front and rear screens (not shown) are also provided. Aligned with the chamber, in order to facilitate the movement of the heater member between its various stations, furthermore, appropriately shaped slots 122 are formed in the side walls 22 of the central "parking" station. In order to gain access to the heater member, when in its parking station, furthermore, a lid 34 is provided which can be hinged out of the way.

Each of the operating stations A,B of the apparatus is provided with two supports 104, 108 for supporting shoe parts, said supports being arranged one at a level above and one at a level below the path of movement of the heater member 82. More specifically, the support 104, which is in form of a wire mesh, is arranged to support a shoe part in the form of a lasted shoe upper U above said path of movement, for heating by radiation emitted by the upper heating surface of the heater member 82. The support 104 is generally V-shaped (see FIG. 1) in order to accommodate to the contour of shoe bottoms. The support 108, which is arranged for supporting a shoe sole unit S beneath said path of movement of the heater member 82, for heating by radiation emitted by the lower heating surface thereof, comprises a wire mesh on which toe and waist regions of a sole unit S can be supported, and a plurality of parallel fiberglass cords coated with silicone rubber for supporting a heel portion thereof.

For heating a lasted shoe upper U and a sole unit S at the same time, since heat is being applied to both parts a temperature of between 410° and 500° C. has been found suitable. The apparatus in accordance with the invention may, however, also be used to heat only one of the two parts; in practice, in such circumstances the sole unit S only is heated. In such a case it is necessary to input sufficient heat into the sole unit to activate the adhesive on the lasted shoe upper when contacted by the sole unit; to this end a higher temperature, within the range 540° to 625° C., has been found suitable. Where only the sole unit is to be heated as aforesaid, if desired a further screen (not shown) may be placed over the support 104, to prevent the escape of heat during the operating cycle causing the discomfort to the operator; alternatively, if it is desired merely to warm the shoe upper during the heating of the sole unit, a grid (not shown) may be supported above the support 104.

The apparatus in accordance with the invention also comprises control means by which the operator can control when an operating cycle of the apparatus is to be terminated firstly by delaying the start of an operating cycle and thereafter by controlling the duration of such cycle. Thus, the control means includes two actuator buttons 124, one associated with each of the two operating stations A,B, actuation of which is effective to cause the drive means to operate to move the heater from its central "parking" station to the appropriate operating station.

For delaying the start of the operating cycle for a pre-determined time after the appropriate actuator button 124 has been actuated, the apparatus comprises first timer means, in the form of a timer 126, which the operator can set for a given time delay. Similarly, second timer means, in the form of a second timer 128, is provided by which the operator can set the duration of the operating cycle once the heater has arrived at the appropriate operating station.

In practice, the duration of the operating cycle is likely to be between 4 and 8 seconds, more particularly 6 seconds, but will of course vary according to the nature of the adhesive to be actuated. With regard to the initial delay, bearing in mind that in normal operation, using a cement sole attaching machine, a cycle of operation thereof will be initiated every 10 seconds or so depending upon the skill and dexterity of the operator, the operator will set the delay, using the first timer 126, to give a total operating time for the apparatus in accordance with the invention, which takes into account not only the duration of the operating cycle, but also the time taken to move the heater from the central "parking" station to the operating station.

I claim:

1. A shoe machine for heating a shoe part comprising:

housing means defining a chamber, shroud means located within said chamber and defining first and second operating zones on either side thereof, heating means, means for supporting said heating means for movement from a first operating position within said first operating zone, to a park position within said shroud means and to a second operating position within said second operating zone, means for displacing said heating means between said first operating position and said park position and between said second operating position and said park position, said displacing means including first means including a first timer for initiating displacement of said heating means from said park position to said first operating position following a predetermined time delay, second means including a second timer for initiating displacement of said heating means from said first operating position to said park position following a predetermined time delay, third means including said first timer for initiating displacement of said heating means from said park position to said second operating position following a predetermined time delay, and fourth means including said second timer for initiating displacement of said heating means from said second operating position to said park position following a predetermined time delay, and shoe part support means located within said first and second operating zones.

2. A shoe machine for heating a shoe part according to claim 1 further comprising means for continuously operating said heating means at a selected operating temperature.

3. A shoe machine for heating a shoe part according to claim 1, wherein said shoe part support means includes upper and lower supports for supporting shoe parts above and below said heating means.

4. A shoe machine for heating a shoe part according to claim 1, wherein said first and third means are manually actuated.

5. A shoe machine for heating a shoe part according to claim 4, wherein said first and second timers are manually adjustable.

6. A shoe machine for heating a shoe part according to claim 1, wherein said shroud means substantially encloses said heating means when said heating means is at said park position.

* * * * *